US005271221A

United States Patent [19]

Lyon

[11] Patent Number: 5,271,221

[45] Date of Patent: Dec. 21, 1993

[54] INTEGRATED FEEDBACK CONTROLLED SECONDARY AIR INJECTION AND EGR

[75] Inventor: Peter M. Lyon, Birmingham, Mich.

[73] Assignee: Ford Motor Company, Dearborn, Mich.

[21] Appl. No.: 986,414

[22] Filed: Dec. 7, 1992

[51] Int. Cl.[5] ..... F02M 25/06

[52] U.S. Cl. ..... 60/274; 60/278; 60/289

[58] Field of Search ..... 60/274, 278, 289, 290

[56] References Cited

U.S. PATENT DOCUMENTS

| | | | |
|---|---|---|---|
| 3,580,232 | 5/1971 | Sarto | 60/278 |
| 4,088,101 | 5/1978 | Wakita | 60/278 |
| 4,149,377 | 4/1979 | Takagi | 60/278 |

*Primary Examiner*—Douglas Hart

*Attorney, Agent, or Firm*—Peter Abolins; Roger L. May

[57] ABSTRACT

An integral system controls exhaust gas recirculation and secondary air injection for an internal combustion engine. An air pump is coupled to the exhaust manifold through a series combination of a secondary air control valve, a check valve and an orifice for measuring flow. An intake manifold is coupled to the exhaust manifold through an exhaust gas recirculation flow control valve and the orifice. A vacuum source is selectively coupled to the secondary air control valve and the EGR flow control valve for introducing secondary air to the exhaust manifold or introducing exhaust gas recirculation to the intake manifold.

7 Claims, 2 Drawing Sheets

INTEGRATED FEEDBACK CONTROLLED SECONDARY AIR INJECTION AND EGR

BACKGROUND OF THE INVENTION

1. Field of the Invention

This invention relates to control of the operating parameters of an internal combustion engine.

2. Prior Art

It is known to use various means to reduce the output of undesirable emission components from an internal combustion engine. Known techniques include using exhaust gas recirculation (EGR) wherein the exhaust gas from the output of an engine is taken and returned to the intake of the engine. Thus any unoxidized material in the exhaust can be oxidized by passing through the engine again and the temperature in the combustion cylinder is reduced because inert and oxidized material is introduced thereby reducing the volume of material which is oxidized.

It is also known to pump air into the exhaust gas stream to further facilitate oxidation of any remaining material in the exhaust gas stream. Such introduction of air into the exhaust manifold is typically referred to as secondary air injection.

It is known to operate both secondary air injection and the EGR system in an open loop fashion whereby certain engine operating conditions initiate and terminate operation of the EGR and secondary air injection. It would be desirable to have a more accurate way of controlling secondary air injection and EGR. These are some of the problems this invention overcomes.

SUMMARY OF THE DISCLOSURE

This invention uses feedback control operation to control operation of an integrated EGR and secondary air injection system. In particular, a control system can be used in combination with known EGR hardware to provide feedback control of secondary air injection and EGR.

DETAILED DESCRIPTION OF THE INVENTION

Figure 1:
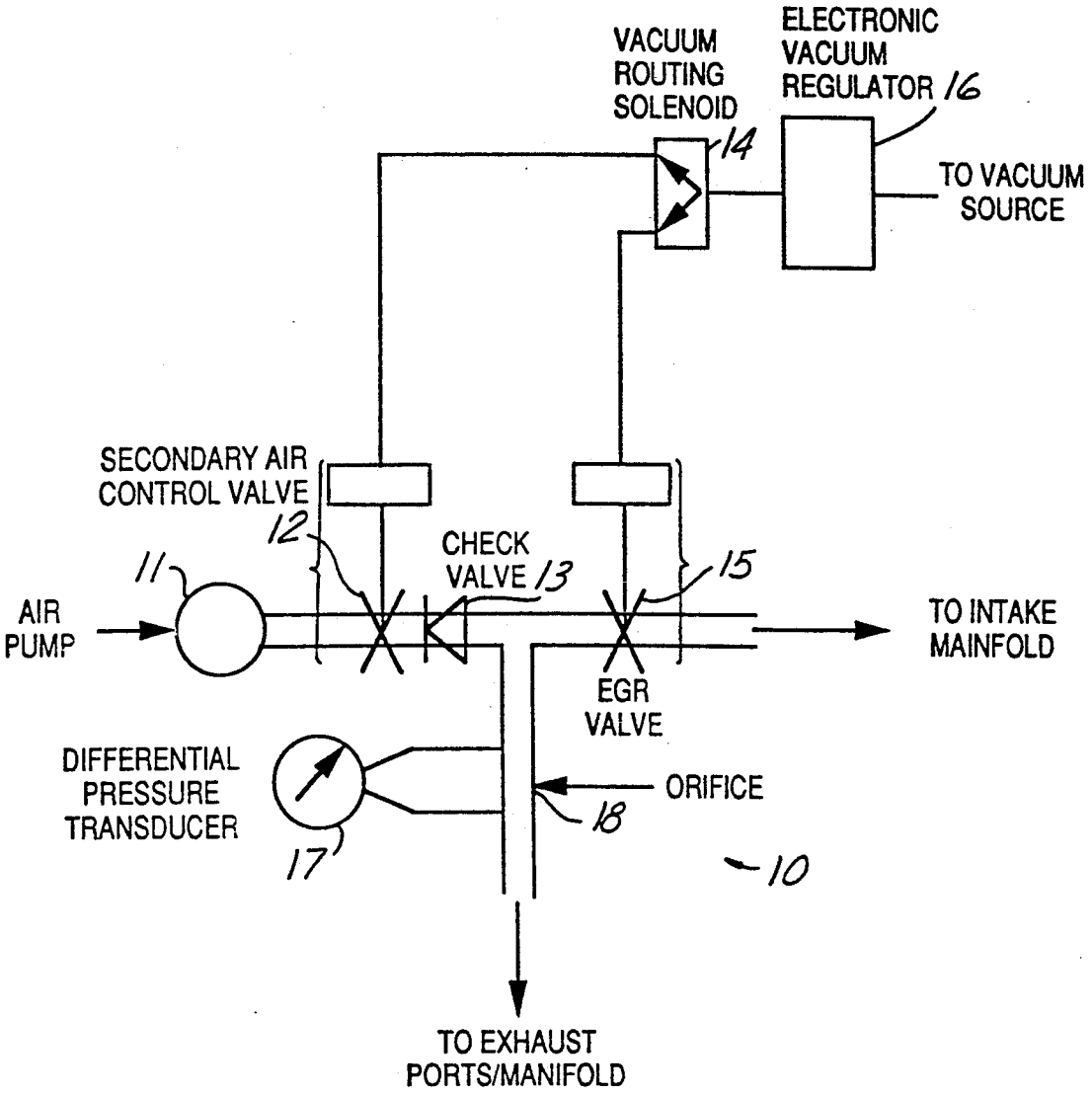
FIG. 1 is a block diagram of an integrated exhaust gas recirculation system and secondary air injection system using feedback control in accordance with an embodiment of this invention.

Referring to FIG. 1, an integrated exhaust gas recirculation system and secondary air injection system 10 includes an air pump 11 which supplies air to an exhaust manifold through the combination of a secondary air control valve 12, a check valve 13, and an orifice 18 around which is coupled a differential pressure transducer 17. Also included is an EGR valve 15 connected at a point between the check valve 13 and the intake manifold. A vacuum source is coupled through an electronic vacuum regulator 16 and a vacuum routing solenoid 14 to EGR valve 15 and secondary air control valve 12.

Figure 2:
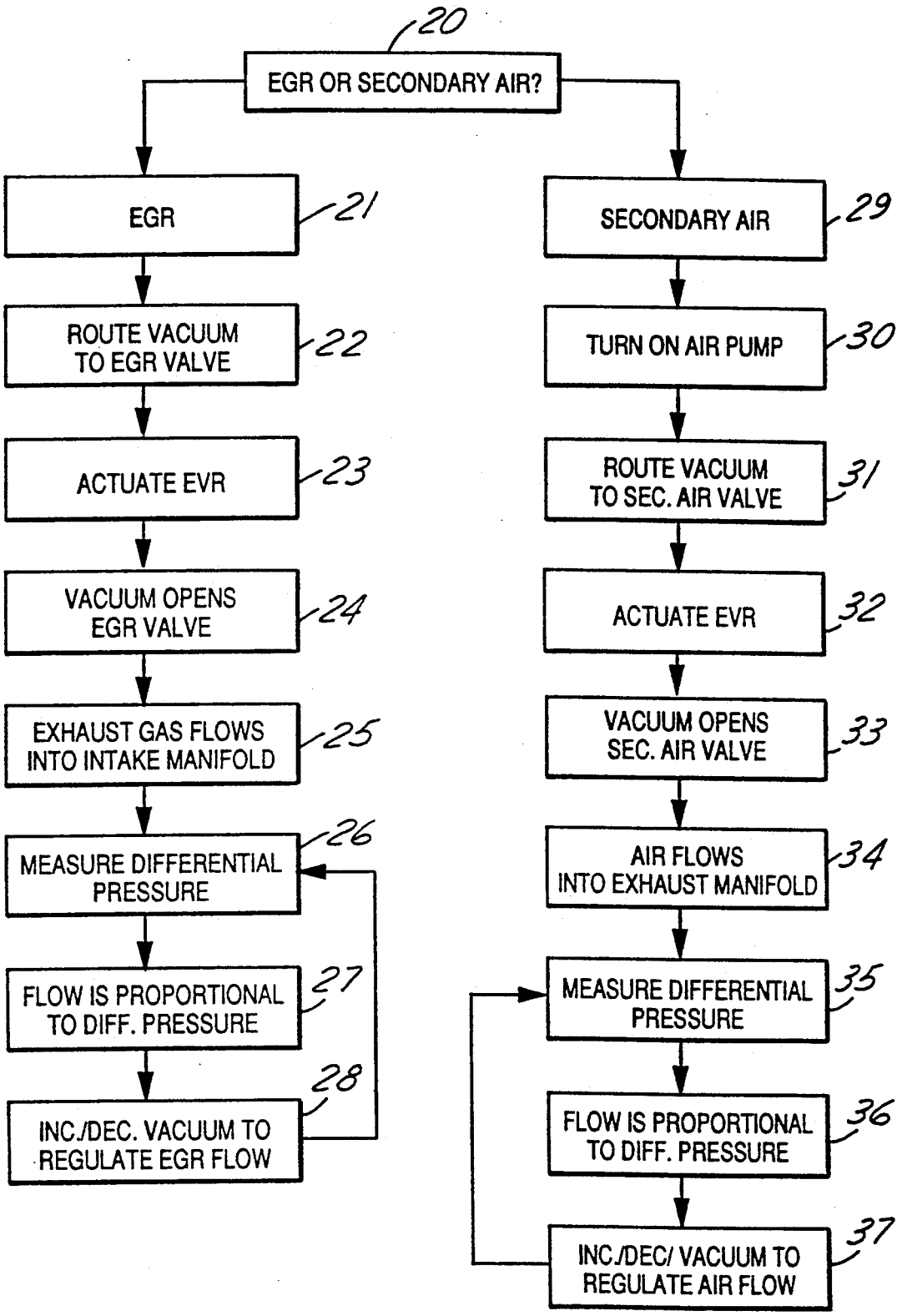
FIG. 2 is a logic flow block diagram of a feed back controlled integrated EGR and secondary air injection system in accordance with an embodiment of this invention.

Referring to FIG. 2, logic operation of an integrated EGR secondary feedback air system includes a block 20 wherein it is questioned whether there should be EGR actuation or secondary air injection. If EGR actuation is chosen, logic flow goes to a block 21 where EGR is selected. Logic flow from block 21 goes to a block 22 wherein vacuum from the vacuum source is routed to EGR valve 15. That is, vacuum is applied from the vacuum source through electronic vacuum regulator 16 and a vacuum routing solenoid 14 to EGR valve 15. Logic flow from block 22 goes to a block 23 wherein there is actuated electronic vacuum regulator 16 (EVR). Logic flow then goes to a block 24 wherein the vacuum opens EGR valve 15. Logic flow then goes to a block 25 wherein the exhaust gas flows into the intake manifold. Logic flow then goes to a block 26 wherein differential pressure across orifice 18 is measured by differential pressure transducer 17. Logic flow then goes to a block 27 wherein flow across orifice 18 is controlled to be proportional to the differential pressure. Logic flow then goes to a block 28 wherein there is an increase or decrease in the vacuum applied to EGR valve 15 to regulate the EGR flow. Logic flow then goes back to block 26 wherein the differential Pressure is measured and the cycle through blocks 27 and 28 is repeated.

Returning to block 20, if secondary air injection is chosen, logic flow goes to a block 29 and then to a block 30 wherein air pump 11 is turned on. Logic flow then goes to a block 31 wherein vacuum is routed to the secondary air valve 12 through vacuum routing solenoid 14 and electronic vacuum regulator 16. Logic flow then goes to a block 32 wherein there is actuated EVR 16. Logic flow then goes to a block 33 where the vacuum opens secondary air valve 12. Logic flow then goes to block 34 wherein secondary air flows into the exhaust manifold and then to a block 35 wherein there is a measurement of the differential pressure across orifice 18 using differential pressure transducer 17. Flow across orifice 18 is controlled proportional to the differential pressure at block 36. Logic flow then goes to a block 37 wherein there is an increase or decrease in vacuum to regulate the secondary air flow. Logic flow from block 37 goes back to block 35 wherein the actions of block 35, 36 and 37 are repeated.

During secondary air injection operation, air is pumped by air pump 11 through control valve 12, check valve 13, and orifice 18 into the exhaust manifold The pressure drop across orifice 18 is measured by pressure transducer 17. Engine control system 10 can then infer the air flow from this signal and control the operation of secondary air control valve 12, via electronic vacuum regulator 16, to maintain a desired flow. During this mode of operation, EGR valve 15 is closed.

During the EGR operation mode, vacuum routing valve solenoid 14 is switched to couple the vacuum source to EGR valve 15. EGR flow is controlled in a similar manner to controlling secondary air flow with control system 10 monitoring the pressure differential across orifice 18. During EGR operation, exhaust gases are drawn from the exhaust system, through orifice 18 and EGR control valve 15, into the intake manifold. As before, the pressure drop across orifice 18 is measured by differential pressure transducer 17. Engine control system 10 can infer the EGR flow from this signal and control EGR valve 15, via vacuum regulator 16 and vacuum routing solenoid 14, to maintain a desired flow of exhaust gas to the intake manifold. During this mode secondary air control valve 12 is closed.

Both operation modes use the same control orifice 18, differential pressure transducer 17, vacuum routing solenoid 14, and electronic vacuum regulator 16.

What is claimed:

1. An apparatus for controlling exhaust gas recirculation (EGR) and secondary air injection for an internal combustion engine including:

an air pump coupled to the exhaust manifold through a series combination of a secondary air control valve, a check valve and an orifice;

a differential pressure transducer coupled across said orifice;

said exhaust manifold being coupled to the intake manifold through said orifice and an EGR flow control valve; and a vacuum source selectively coupled to said secondary air control valve and said EGR flow control valve for selectively introducing secondary air to the exhaust manifold or introducing exhaust gas recirculation to the intake manifold.

2. An apparatus as recited in claim 1 wherein said vacuum source is coupled to said secondary air control valve and said EGR valve through a series combination of an electronic vacuum regulator and a vacuum routing solenoid.

3. An apparatus as recited in claim 2 wherein said electronic vacuum regulator is responsively coupled to said differential pressure transducer to regulate the application of the vacuum .

4. An apparatus as recited in claim 3 wherein said vacuum routing solenoid is coupled to said vacuum source through said electronic vacuum regulator whereby vacuum is routed either to said secondary air control valve or to said EGR valve for operation.

5. A method of controlling integrated exhaust gas recirculation (EGR) and secondary, air injection for an internal combustion engine including the steps of:

selecting to perform either exhaust gas recirculation or secondary air injection;

sensing EFR flow;

if exhaust gas recirculation is selected applying the exhaust from an exhaust manifold to an intake manifold and adjusting an EGR control valve position in response to sensed EGR flow; and sensing secondary air flow into the exhaust manifold;

if secondary air injection is selected, applying secondary air to the exhaust manifold and controlling the position of a secondary air flow control valve in response to sensed secondary air flow into the exhaust manifold.

6. A method as recited in claim 5 wherein controlling EGR includes the steps of:

routing vacuum to the EGR control valve through an electronic vacuum regulator;

actuating the electronic vacuum regulator;

applying vacuum through the electronic vacuum regulator to open the EGR control valve;

applying exhaust gas flow into the intake manifold;

measuring a differential pressure as exhaust gas flows through an orifice;

recognizing that exhaust gas flow is proportional to the differential pressure;

increasing or decreasing the vacuum applied to the EGR control valve to regulate the EGR flow; and repeatedly measuring differential pressure and increasing or decreasing the vacuum to regulate EGR flow in response to the measured differential pressure.

7. A method as recited in claim 6 further comprising the steps of controlling secondary air using the method of:

turning on an air pump;

routing vacuum to the secondary air flow control valve;

actuating the electronic vacuum regulator;

applying vacuum so as to open the secondary air control valve and thus providing secondary air flow into the exhaust manifold;

measuring a differential pressure of said air flow through an orifice using a differential pressure measurement;

recognizing that secondary air flow is proportional to differential pressure; and increasing and decreasing the vacuum applied to the secondary air control valve to regulate the air flow; and repeatedly measuring the differential pressure and increasing or decreasing the vacuum to regulate the secondary air flow in response to the measured differential pressure.

* * * * *